US005766046A

United States Patent [19]

Ogino

[11] Patent Number: 5,766,046

[45] Date of Patent: Jun. 16, 1998

[54] COOLING WATER PICKUP FOR MARINE PROPULSION UNIT

[75] Inventor: Hiroshi Ogino, Iwata, Japan

[73] Assignee: Sanshin Kogyo Kabushiki Kaisha, Hamamatsu, Japan

[21] Appl. No.: 669,241

[22] Filed: Jun. 24, 1996

[30] Foreign Application Priority Data

Jun. 23, 1995 [JP] Japan ..... 7-180752

[51] Int. Cl.[6] ..... B63H 20/38

[52] U.S. Cl. ..... 440/78; 440/88

[58] Field of Search ..... 440/88, 78

[56] References Cited

U.S. PATENT DOCUMENTS

| | | | |
|---|---|---|---|
| Re. 18,118 | 7/1931 | Pierce | 440/88 |
| 2,021,309 | 11/1935 | Irgens | 440/78 |
| 2,153,626 | 4/1939 | Kissel | 440/88 |
| 3,908,579 | 9/1975 | Miller et al. | 440/88 |
| 4,832,635 | 5/1989 | McCormick | 440/88 |

*Primary Examiner*—Sherman Basinger

*Attorney, Agent, or Firm*—Knobbe, Martens, Olson & Bear LLP

[57] ABSTRACT

An improved water pickup arrangement for a marine propulsion device for picking up cooling water for the propelling, water-cooled internal combustion engine. The lower unit has a bullet-shaped portion and the water inlet openings are formed at the forward and upper ends of this portion.

4 Claims, 7 Drawing Sheets

COOLING WATER PICKUP FOR MARINE PROPULSION UNIT

BACKGROUND OF THE INVENTION

This invention relates to a cooling water pick up arrangement for a marine propulsion unit and more particularly to an improved water pick up arrangement for such applications.

As is typical in many types of watercraft propulsion systems using outboard drives, the cooling water for the engine is picked up from a water inlet opening formed in the lower unit of the propulsion system. This type of water pick up arrangement is used in not only outboard motors, but also in the outboard drive portion of an inboard-outboard drive. These types of propulsion systems are generally referred to as outboard propulsion or drive systems, since the propulsion unit is mounted outboard of the hull of the watercraft.

Obviously, it is necessary for the water inlet opening to be disposed in an area of the propulsion unit outer housing that is submerged at all times that the watercraft is operating. With conventional propulsion systems, this is not necessarily a problem since a fairly substantial portion of the lower unit is submerged under all running conditions. However, in order to improve performance and reduce drag, it has been proposed to provide systems wherein the outboard drives operate such that the propulsion unit, normally propellers, are not totally submerged during watercraft operation. By reducing the degree of submersion of both the propellers and the outboard drive housing, performance can be improved.

However, when this is done, then there is a risk that the water pick up will be disposed above the water level. Alternatively, even if the water inlet is submerged under some running conditions, under certain running conditions such as when the watercraft is encountering a porpoising effect, the water inlet may become uncovered and cooling of the propulsion unit can be adversely affected.

It is, therefore, a principal object of the invention to provide an improved water pick up arrangement for a marine propulsion unit.

It is a further object of this invention to provide a water pick up device for a marine propulsion unit wherein the water pick up will be submerged under all running conditions so as to ensure adequate cooling of the engine.

SUMMARY OF THE INVENTION

This invention is adapted to be embodied in a marine propulsion device that is comprised of a lower unit having an outer casing containing a propeller shaft and transmission driven by a water cooled internal combustion engine for driving the propeller shaft. The outer casing has a forward end disposed adjacent and containing the forward end of the propeller shaft. A water inlet opening is formed in the forward end of the lower unit for collecting water and delivering it to the engine for its cooling.

DETAILED DESCRIPTION OF THE PREFERRED EMBODIMENTS OF THE INVENTION

Figure 1:
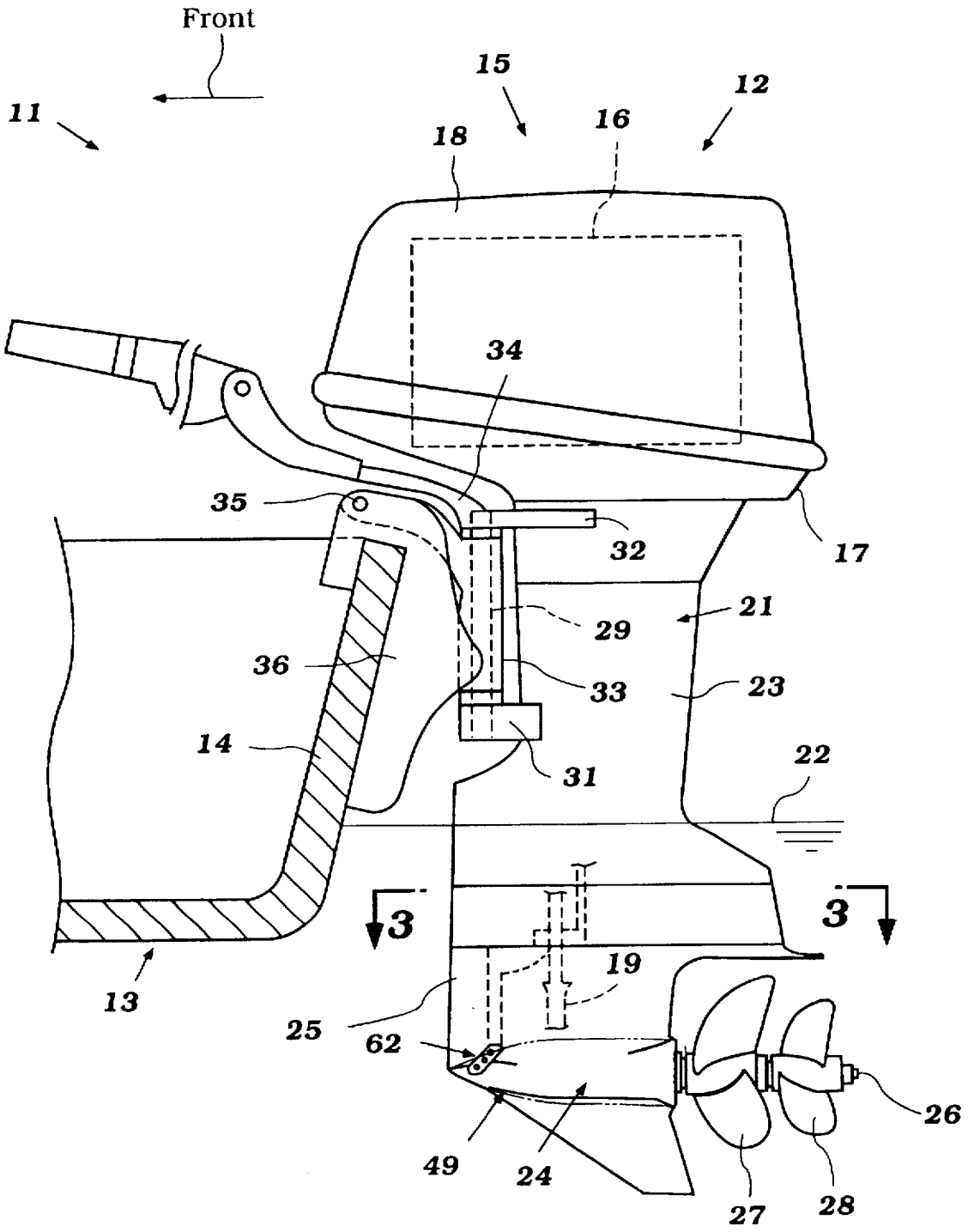
FIG. 1 is a side elevational view of an outboard motor constructed in accordance with an embodiment of the invention and attached to the transom of an associated watercraft, shown partially and in cross-section.

Referring now in detail to the drawings and initially to FIG. 1, a marine propulsion system constructed in accordance with an embodiment of the invention is identified generally by the reference numeral 11. The marine propulsion unit includes an outboard propulsion device, indicated generally by the reference numeral 12 which, in the illustrated embodiment, is comprised of an outboard motor. Although the invention is described in conjunction with an outboard motor, it will be readily apparent that the invention may also be utilized in conjunction with the outboard drive portion of an inboard-outboard drive where that outboard drive portion also serves as the water pick up for collecting cooling water for the powering internal combustion engine.

The outboard motor 12 is connected, in a manner which will be described, to a watercraft hull, shown partially and in cross-section and identified generally by the reference numeral 13. More specifically, the outboard motor 12 is connected to the transom 14 of the watercraft hull 13.

The outboard motor 12 is comprised of a powerhead, indicated generally by the reference numeral 15 that consists of a powering internal combustion engine 16 which may be of any known water cooled type. This internal combustion engine 16 is surrounded by a protective cowling comprised of a lower tray portion 17 and an upper, detachable main cowling portion 18.

As is typical with outboard motor practice, the engine 16 is preferably supported within the powerhead 15 so that its output shaft, normally a crankshaft, rotates about a vertically extending axis. This orientation of the output shaft of the engine 16 facilitates connection to a drive shaft 19 that is supported for rotation about a vertically extending axis within a drive shaft housing 21. The drive shaft housing 21 depends from the tray portion 17 of the powerhead 15 and extends downwardly below the level of water, indicated by the line 22, when the watercraft 13 is stationary. The drive shaft housing 21 is comprised of an outer casing 23 in which bearings (not shown) may be provided for journaling the drive shaft 19.

A lower unit 24 is disposed at the lower end of the drive shaft housing 21 and includes an outer casing 25 which has a configuration as will be described. A pair of concentric propeller shafts, indicated by the reference numerals 26 are telescopically received one within the other and are journaled within the lower unit 24 in a manner which will be described. Propellers 27 and 28 are each affixed to a respective one of the propeller shafts 26. These propellers 27 and 28 provide propulsion force for the watercraft 13 in a manner which will be described.

Continuing to refer primarily to FIG. 1, a steering shaft, indicated by the reference numeral 29 is affixed to the drive shaft housing 21 by means of a lower mounting bracket 31 and an upper mounting bracket 32. The steering shaft is journaled for steering movement about a vertically extending axis within a swivel bracket 33. This pivotal movement of the steering shaft 29 permits steering of the outboard motor 12 about the aforenoted steering axis in a manner well known in this art. A tiller 34 is affixed to the upper end of the steering shaft 29 so as to facilitate this steering.

The swivel bracket 33 is pivotally connected by means of a pivot pin 35 to a clamping bracket 36. The clamping bracket 36 is, in turn, affixed in a suitable manner to the transom 14. The pivot pin 35 permits tilt and trim movement of the outboard motor 12 as is well known in this art.

The construction of the outboard motor 12 as thus far described may be considered to be conventional and, for that reason, further description of components of the outboard motor which are not directly related to the invention will not be made. Reference may be had to any known constructions in the art for details of the construction of the outboard motor 12 or of the outboard drive portions of an inboard/outboard drive for any details which are not contained herein.

Figure 2:
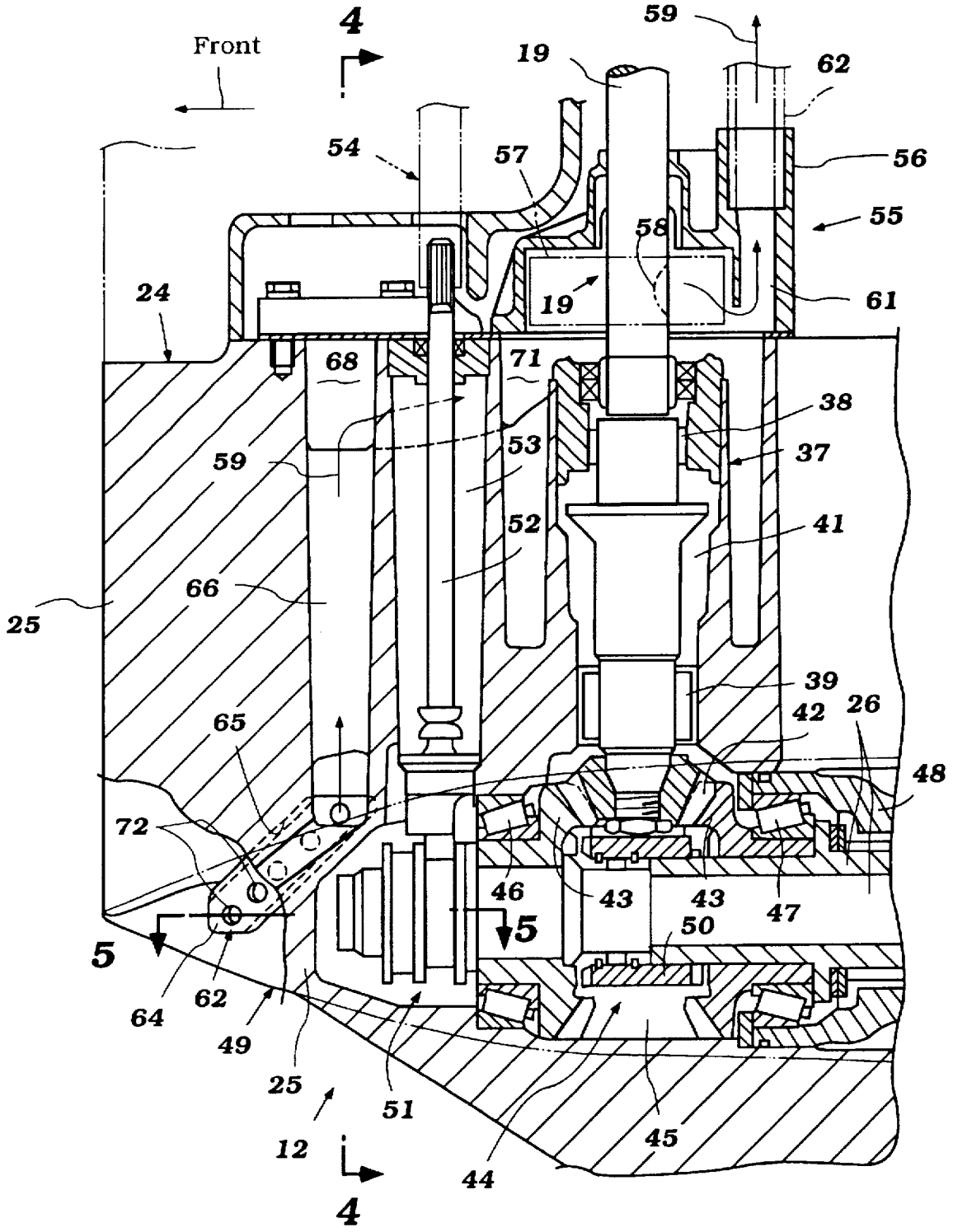
FIG. 2 is an enlarged cross-sectional view taken through the lower unit of the outboard motor and shows the final drive and the relationship to the water pick up system.
Figure 3:
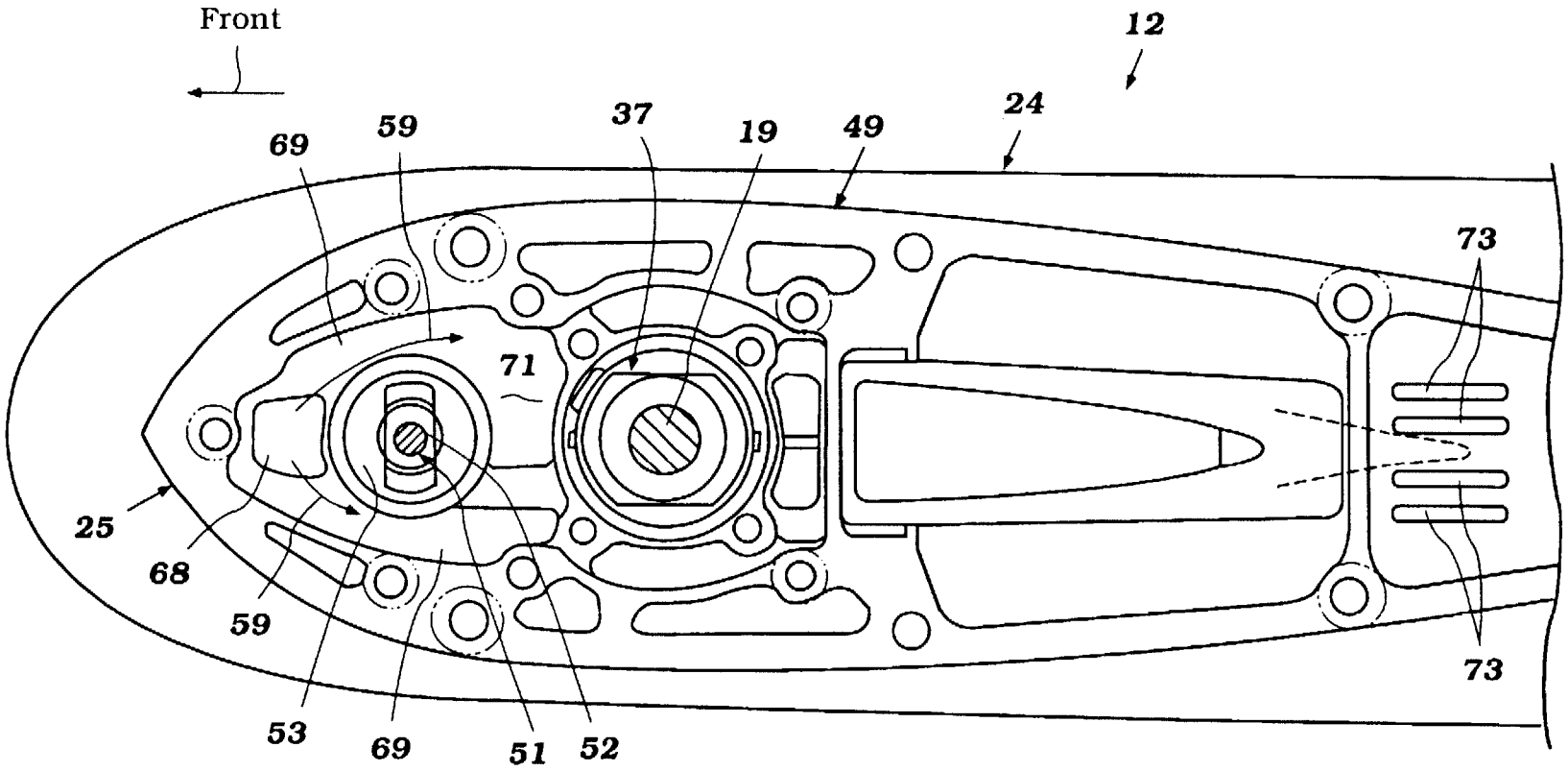
FIG. 3 is an enlarged cross-sectional view taken along the line 3—3 of FIG. 1.
Figure 4:
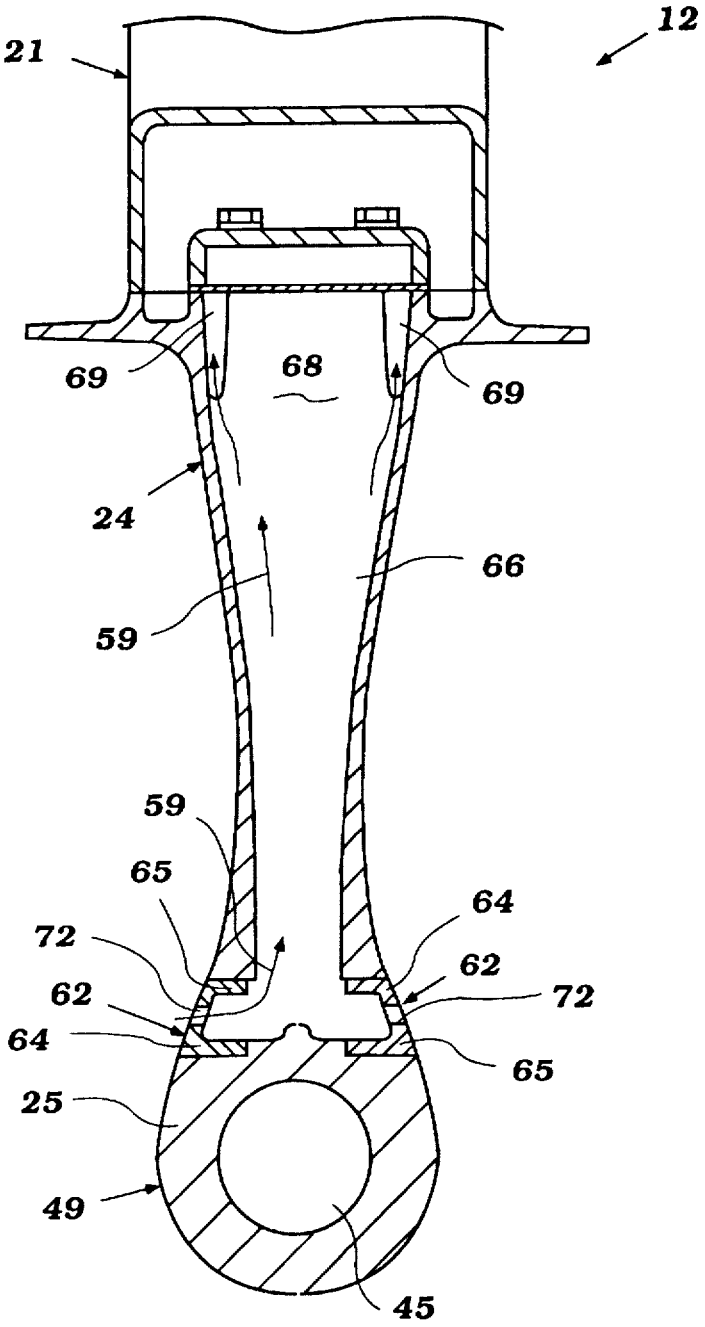
FIG. 4 is a cross-sectional view taken along the line 4—4 of FIG. 2.

Referring now primarily to FIGS. 2 and 3, the drive mechanism for the propeller shafts 26 will be described generally. Again, the invention is directed primarily to the water pickup arrangement for collecting cooling water for the water jacket of the engine 16. However, some components of the propulsion drive will be described in order to facilitate the understanding of the invention.

The lower unit outer housing 25 is formed with a drive shaft support portion, indicated generally by the reference numeral 37 which supports an upper bearing 38 and a lower bearing 39 on opposite sides of a cavity 41. The bearings 38 and 39 journal the lower end of the drive shaft 19.

A bevel drive gear 42 is affixed in a known manner to the lower end of the drive shaft 19 and cooperates with a pair of driven bevel gears 43 of a reversing bevel gear transmission, indicated generally by the reference numeral 44. This transmission 44 is contained within a transmission cavity 45 of the lower unit outer housing 25.

The hubs of the bevel gears 43 are journaled by means of a pair of thrust bearings 46 and 47 which, in turn, also support the propeller shafts 26.

In addition, a bearing carrier 48 extends rearwardly into a bullet-shaped portion 49 of the outer housing 25 for journaling the rear ends of the propeller shafts 26. For the aforenoted reasons, further details of the transmission 44 are not believed to be necessary to permit those skilled in the art to practice the invention.

However, it should be noted that the transmission 44 includes a shifting clutch 50 that is operated by a cam and follower mechanism, indicated generally by the reference numeral 51 that is disposed forwardly of the propeller shaft 26. A shift actuator 52 is journaled within a cavity 53 formed forwardly of the propeller shaft cavity 41 within the casing 25. The upper end of the shift actuator 52 is connected by means of a splined connection to a shift control rod 54 that is operated in a manner known in this art to effect shifting of the transmission 44.

Although the details of the transmission 44 form no part of the invention, it should be understood that this transmission may operate so as to drive the propellers 27 and 28 in opposite directions during either or both of the forward or reverse drive modes. In some cases only one of the propellers 27 or 28 may be driven in reverse.

As has been noted, the engine 16, although it may be of any known type including any of the known two-cycle, four-cycle reciprocating and/or rotary engines, is water cooled. Coolant is circulated through the cooling jackets of the engine 16 by a coolant pump, indicated generally by the reference numeral 55 and which is positioned at the interface between the outer housing 25 of the lower unit 24 and the outer housing 23 of the drive shaft housing 21. This coolant pump is comprised of pump casing 56 through which the drive shaft 19 extends. A pump impeller 57 is contained within this casing 56 and is coupled by means of a keyed connection 58 to the drive shaft 19 so as to be driven thereby. The water pumped flows through a path indicated by the arrows 59 and is discharged from the pump housing 56 through a discharge passage 61. A water delivery tube 62 cooperates with this passage 61 so as to convey water upwardly to the engine 16. Like the other details of the outboard motor 12 as thus far described, the water pump 55 and its drive arrangement also may be considered to be conventional. Therefore, reference may be had to any known construction for the details of the water pump assembly.

The invention deals primarily with the water pickup arrangement for delivering water to the water pump 55 and the engine cooling jackets. This water pickup device is comprised of a pair of pickup members, indicated generally by the reference numeral 63 which are mounted at the forward end of the bullet-shaped portion 49 of the lower unit outer housing 25 and which extend from a point just slightly below the rotation axes of the propeller shafts 26 upwardly and in a rearwardly inclined direction.

These pickup devices 63 are comprised of metallic members 64 which are received within recesses 65 formed in the bullet-shaped portion 49 of the lower unit housing 25 and which extend on its upper side in a rearwardly inclined direction as aforenoted.

The bullet shaped portion 49 is formed at the lower terminus of a portion of the lower unit housing 25 that has a tapered configuration as seen at 25A in a cross-section that extends perpendicularly to the axis of the drive shaft 19 and as best seen in FIG. 3. The forward end 49A of the bullet-shaped portion 49 is substantially coincident with the forward end of this tapered portion, as best seen in FIG. 5 and these forward ends define a continuous, generally verticaly extending forward end of the lower unit outer housing.

The receiving cavities 65 are formed at the outer termination of a pair of vertically extending water delivery passages 66 which are formed integrally within the lower unit outer housing 25 and which extend generally vertically upwardly forwardly of the cavity 53 in which the shift control rod 52 is positioned. These passages 66 are separated by an integral vertically-extending wall 67 and thus provide good water flow area but nevertheless does not decrease the structural integrity of the lower unit 24.

At their upper ends, the passages 66 merge into a common portion 68 which communicates with a pair of rearwardly extending cavities 69 that communicate along the sides of the shift rod cavity 53 with a larger cavity 71 that communicates with the water inlet opening of the pump housing 56 so as to deliver cooling water thereto.

Figure 5:
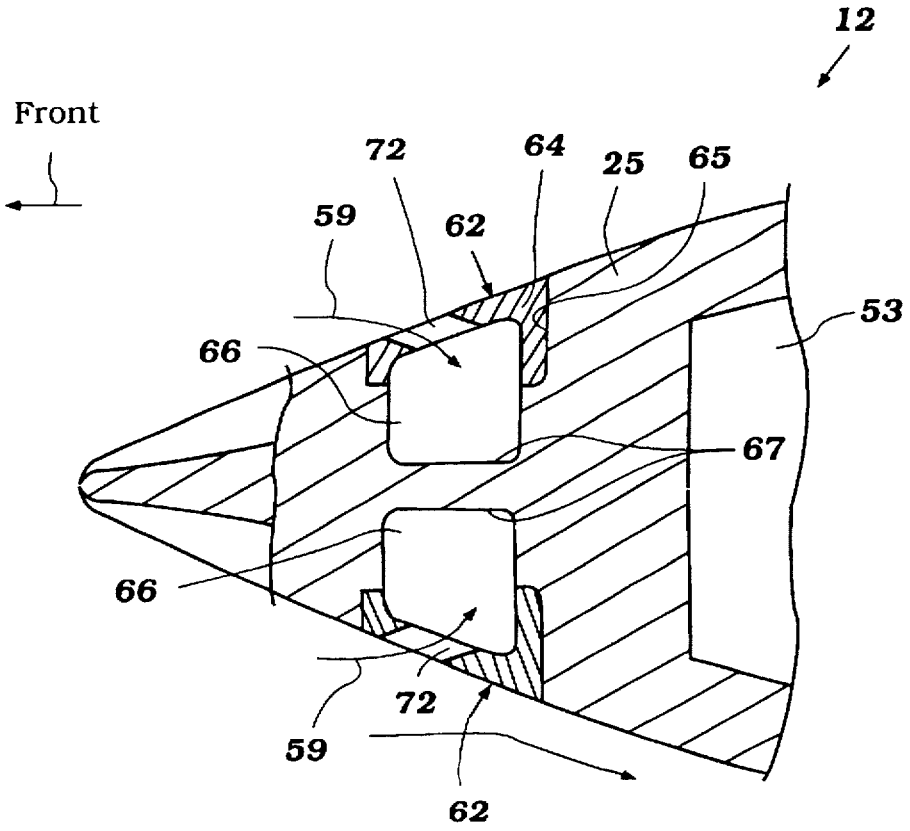
FIG. 5 is a broken wave view, taken generally along the line 5—5 of FIG. 2 showing the water pick up construction.

The water inlet members 63 are formed, in this embodiment, with a plurality of water passage openings 72 which are configured so as to extend generally forwardly as shown in FIG. 5 so as to cause a ram effect on the water pickup. In this way, a copious amount of water will be available for delivery by the pump 55 even though the lower unit 24 may be only relatively shallowly submerged during watercraft running, particularly at high velocities. Thus, even if porpoising may be encountered, the water will always be picked up since the lower of the openings 72 is disposed in substantial alignment with the propeller shafts 26 which are slightly below water level even under extreme conditions.

Figure 6:
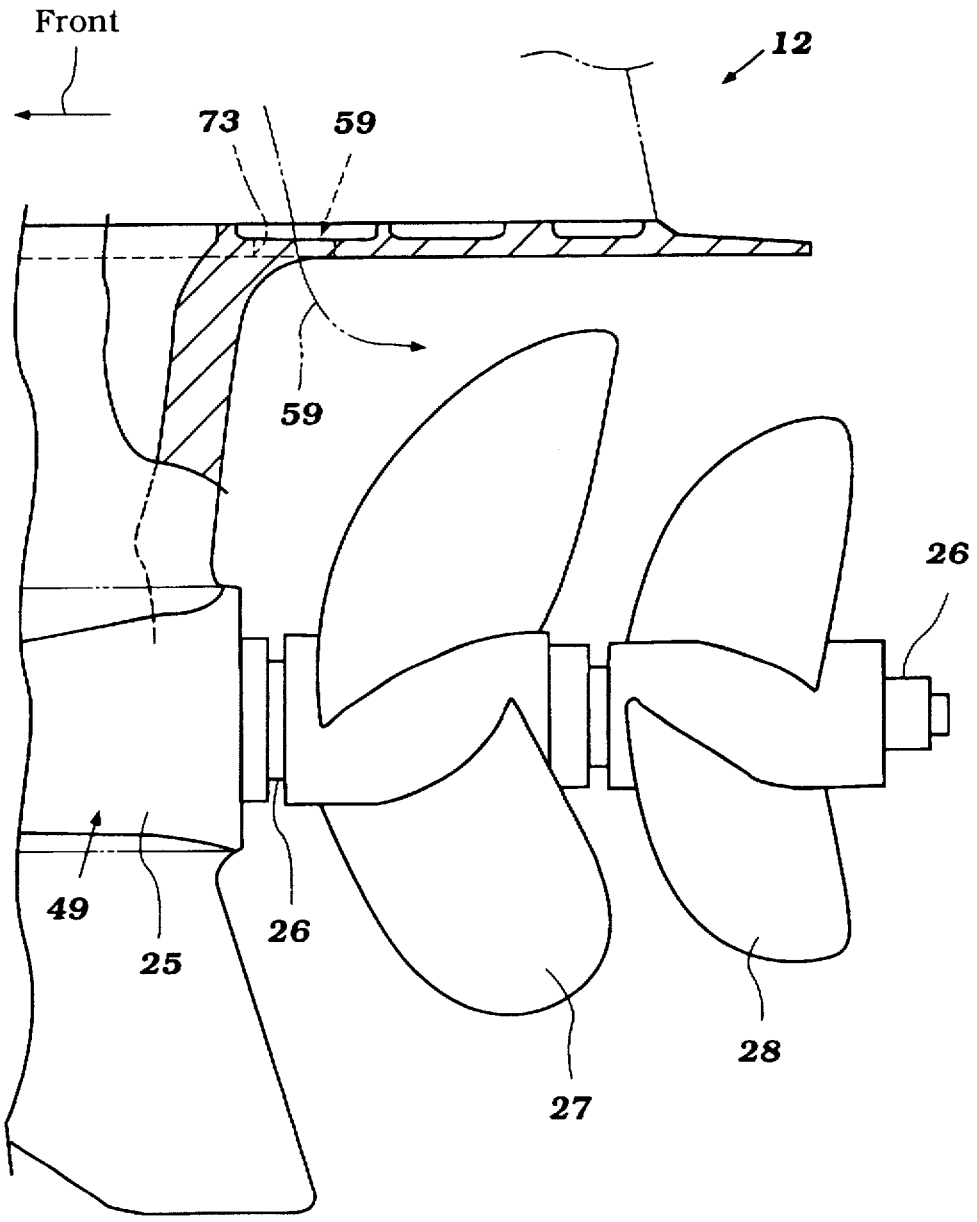
FIG. 6 is a side elevational view with a portion broken away and shows the relationship of the propellers to the anti-cavitation plate and the cooling water discharge.

The water which is then picked up and circulated through the engine is returned back to the body of water in which the watercraft is operating through a plurality of discharge slots 73 (FIGS. 3 and 6) so that the water will be returned as shown by the arrows 59 in proximity to the upper periphery of the propellers 27 and 28. As a result, a smooth water flow through the engine cooling system is provided.

Figure 7:
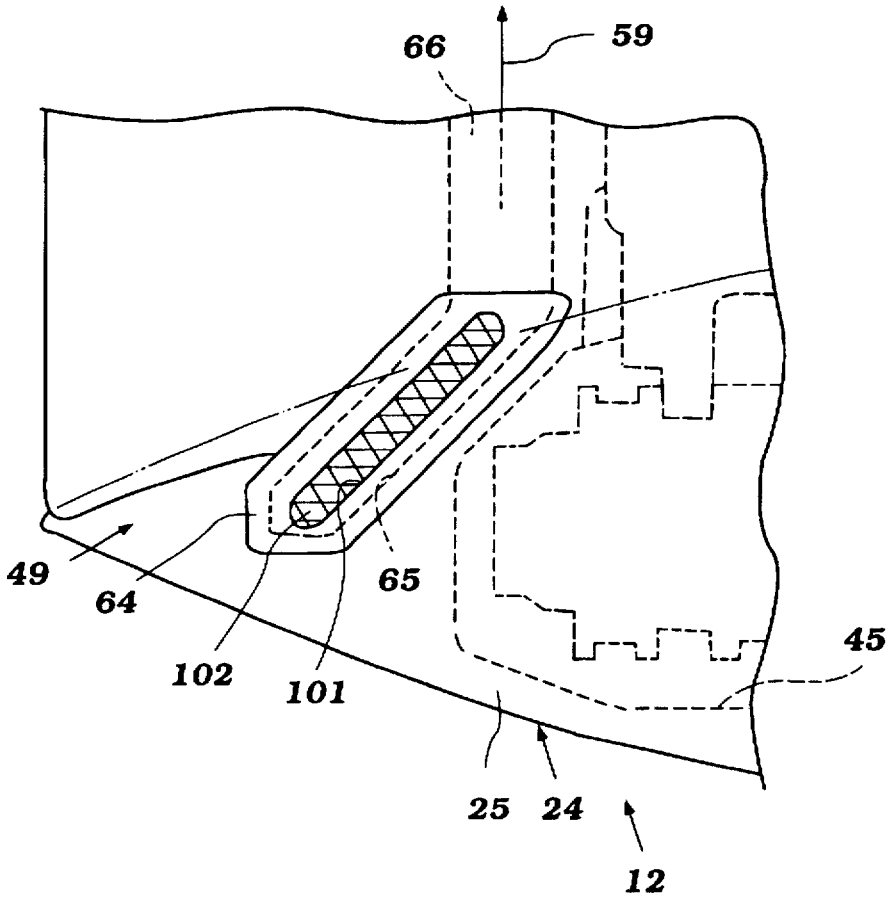
FIG. 7 is an enlarged side elevational view showing a water pick up construction constructed in accordance with another embodiment of the invention.

FIG. 7 shows another embodiment of the invention which differs from the previously described embodiment only in the configuration of the water inlet openings formed in the water pickup member 63. In this embodiment, an elongated slotted opening 101 is provided which extends upwardly and rearwardly as shown in FIG. 7. This provides a larger inlet area and a screen member 102 as mounted in each member 64. These screen-like members 102 will ensure that large foreign particles cannot be entrained in the cooling system and interfere with the operation of the pump impeller 57.

Thus, from the foregoing description it should be readily apparent that the described embodiments of the invention are particularly effective in providing good water flow to a marine propulsion system from inlets in the lower unit which are only shallowly submerged under some running conditions but which will ensure complete water pickup under all conditions. Of course, the foregoing description is that of a the preferred embodiments of the invention and various changes and modifications may be made without departing from the spirit and scope of the invention, as defined by the appended claims.

What is claimed is:

1. A marine propulsion device comprised of a lower unit having an outer casing containing a propeller shaft in a transmission driven by a water-cooled internal combustion engine for driving said propeller shaft, said outer casing having a generally bullet-shaped portion formed at the lower end of a tapered portion, the forward ends of said tapered portion and said bullet-shaped portion lying, on a continuous generally vertically extending forward edge of said outer casing said bullet-shaped portion having its forward end disposed adjacent and containing the forward end of said propeller shaft, and a water inlet opening formed in said bullet shaped portion to the rear of said forward end thereof and primarily extending upwardly from an axis of said propeller shaft for collecting water for delivery to said engine for its cooling jacket.

2. A marine propulsion device as set forth in claim 1, wherein the water inlet opening comprises a pair of openings formed on opposite sides of the bullet-shaped portion.

3. A marine propulsion device as set forth in claim 2, wherein the water inlet openings extend generally upwardly and rearwardly and have open, forward ends for creating a ram water effect.

4. A marine propulsion device as set forth in claim 3, wherein each of the water inlet openings communicates with a vertically extending passage formed in the outer casing and deliver water to a water pump disposed at the upper end of the outer casing.

* * * * *